US007566151B2

(12) United States Patent
Whelan et al.

(10) Patent No.: US 7,566,151 B2
(45) Date of Patent: Jul. 28, 2009

(54) TEMPORARY LIGHTING SUPPORT ASSEMBLY FOR SCAFFOLDING SYSTEMS

(75) Inventors: Brendan Whelan, Fort McMurray (CA); Richard Whelan, St. John's (CA)

(73) Assignee: Sumac Fabrication Company Ltd., Fort McMurray (CA)

( * ) Notice: Subject to any disclaimer, the term of this patent is extended or adjusted under 35 U.S.C. 154(b) by 83 days.

(21) Appl. No.: 11/683,942

(22) Filed: Mar. 8, 2007

(65) Prior Publication Data

US 2007/0211479 A1 Sep. 13, 2007

(30) Foreign Application Priority Data

Mar. 8, 2006 (CA) ..... 2541640

(51) Int. Cl.
*F21S 13/10* (2006.01)

(52) U.S. Cl. ..... 362/431; 362/396; 362/427

(58) Field of Classification Search ..... 362/396, 362/427, 431

See application file for complete search history.

(56) References Cited

U.S. PATENT DOCUMENTS 6,474,844 B1 * 11/2002 Ching ..... 362/285
6,592,241 B1 7/2003 Kovacik
7,008,085 B1 * 3/2006 Czlonka ..... 362/407

FOREIGN PATENT DOCUMENTS

CA 2393092 A1 6/2001

* cited by examiner

*Primary Examiner*—Sandra L O'Shea
*Assistant Examiner*—Jason Moon Han
(74) *Attorney, Agent, or Firm*—Christensen O'Connor Johnson Kindness PLLC

(57) ABSTRACT

The present invention is concerned with providing a support for temporary lighting for use with scaffolding systems. The support assembly comprises of two main components and the required fastening systems to affix lighting fixtures and mast light fixtures embodied in two configurations. The support consists of a thin walled pipe with a tube half clamp welded to one end and a thin walled tee welded to the opposite end. The clamp and tee are orientated to provide the support with a precise mounting position. A second thin walled pipe is positioned concentrically through the tee to create framework that has an angled appearance. The second pipe is maintained annular and concentric to the first pipe by means of two washer type collars welded above and below the tee that constrains both pipes to each other. A small space between the collar and tee provides the second pipe with unconstrained rotational movement. Lanyards incorporated in the support are fixed directly to the scaffold for job site safety concerns. Another aspect of the invention is the tube half clamp, which can provide quick assembly and infinite positional placement on a horizontal or vertical pipe member of a scaffolding system.

7 Claims, 8 Drawing Sheets

TEMPORARY LIGHTING SUPPORT ASSEMBLY FOR SCAFFOLDING SYSTEMS

FIELD OF THE INVENTION

This invention provides a method of setting up temporary lighting on job sites, and more specifically, by affixing the temporary lighting to a scaffolding system by way of a support assembly.

BACKGROUND OF THE INVENTION

It is common on job sites to have temporary lighting for the purpose of carrying out work in dark areas and at night. Temporary lighting around job sites in terms of mounting locations and ability to direct light to a precise location has used many time consuming makeshift solutions such as hanging fixtures from ropes and wires. The typical way to affix temporary lighting is to tie the fixture to overhanging beams and scaffolding members by means of rope or wire. Often light fixtures are located on a platform or floor. This method of affixing temporary lighting requires the appropriate personnel to attach the rope or wire through the lighting fixture and pull or lower it from a suitable platform height to the location the fixture is required. Additional stays are required to point the fixture in the direction of the work area. Tying the fixtures is time consuming and positioning requires several steps. Rope and wire shaping around the job site create additional safety issues. There is little flexibility to position a light fixture to illuminate a precise location as the ropes and wire has several rigidity issues.

SUMMARY OF THE INVENTION

To overcome the above disadvantages, I have determined that a support affixed to the surrounding scaffolding members using a scaffold tube half-clamp as its attachment apparatus provides a safer and quicker way to erect temporary lighting on the job site. Since the support fixture uses a scaffold half clamp it is well known to personnel on the job site and therefore can be readily implemented. The rotational ability of the support provides flexibility to illuminate a precise work area.

This invention with its use of a scaffold clamp as a mounting apparatus allows quick installation and precise location of the light direction. The invention has the dual ability to rotate the support assembly around the scaffold member plus the ability to rotate the fixture about an axis perpendicular to the scaffold axis the upward direction. Fine-tuning of the light fixture via rotation about the bracket gives the qualified person that installs the light fixture the ability to point the light in the final direction without having to disturb the clamp assembly. The pipe attached to the scaffold clamp is of a length that enables the light fixture to setback from the work platform of the scaffold system to avoid personnel on the platform from accidental collisions.

There is therefore provided a support assembly for temporarily attaching lighting fixtures to scaffolding systems. The support assembly comprises an elongate support body, the support body comprising a first elongate portion having a first end and a second end, and a second elongate portion, the second elongate portion being connected to the second end of the first elongate portion at an angle substantially perpendicular to the first elongate portion. A releasable clamp is attached to the first end of the first elongate portion for attaching the elongate support body to a scaffolding system. A lighting fixture attachment is connected to the second elongate portion for attaching a lighting fixture.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
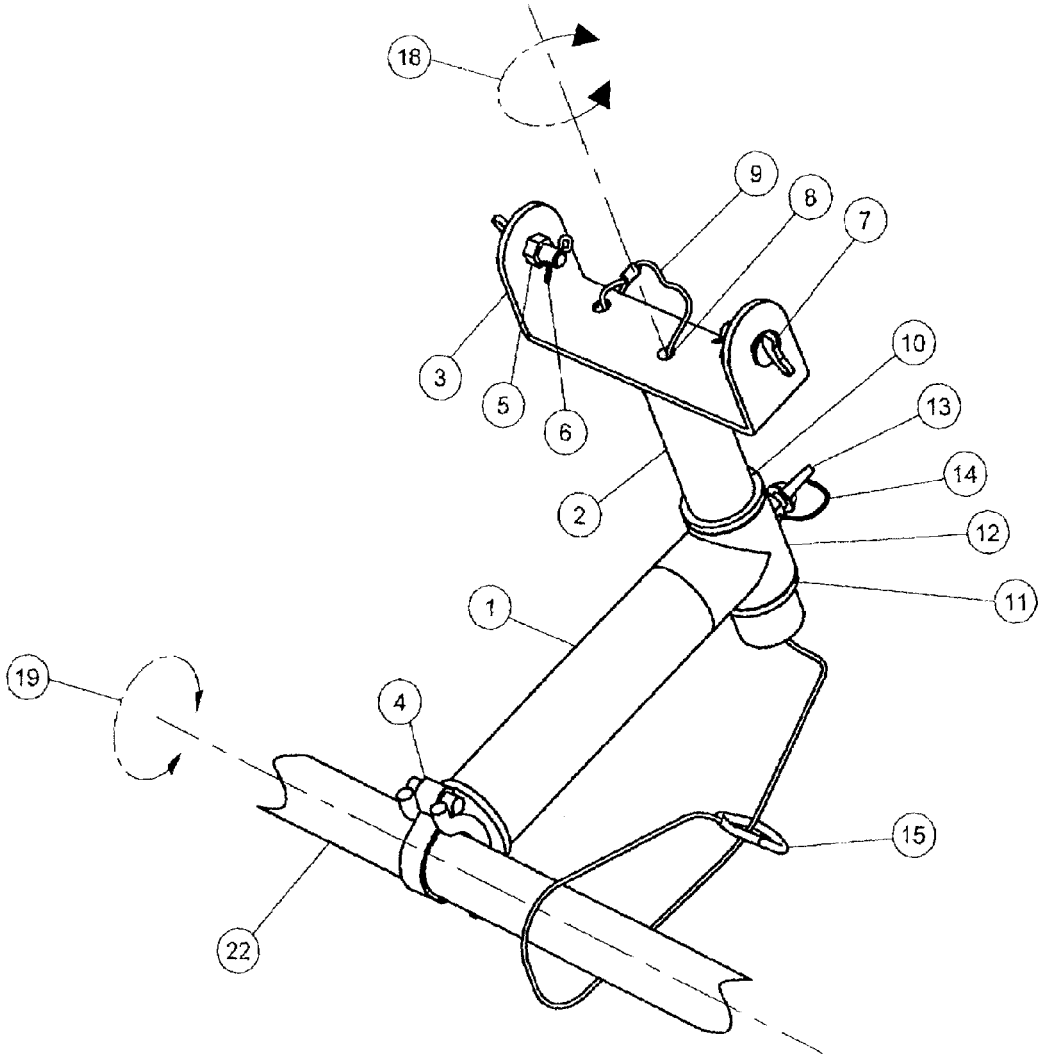
FIG. 1 is an isometric view of a temporary lighting support assembly.
Figure 2:
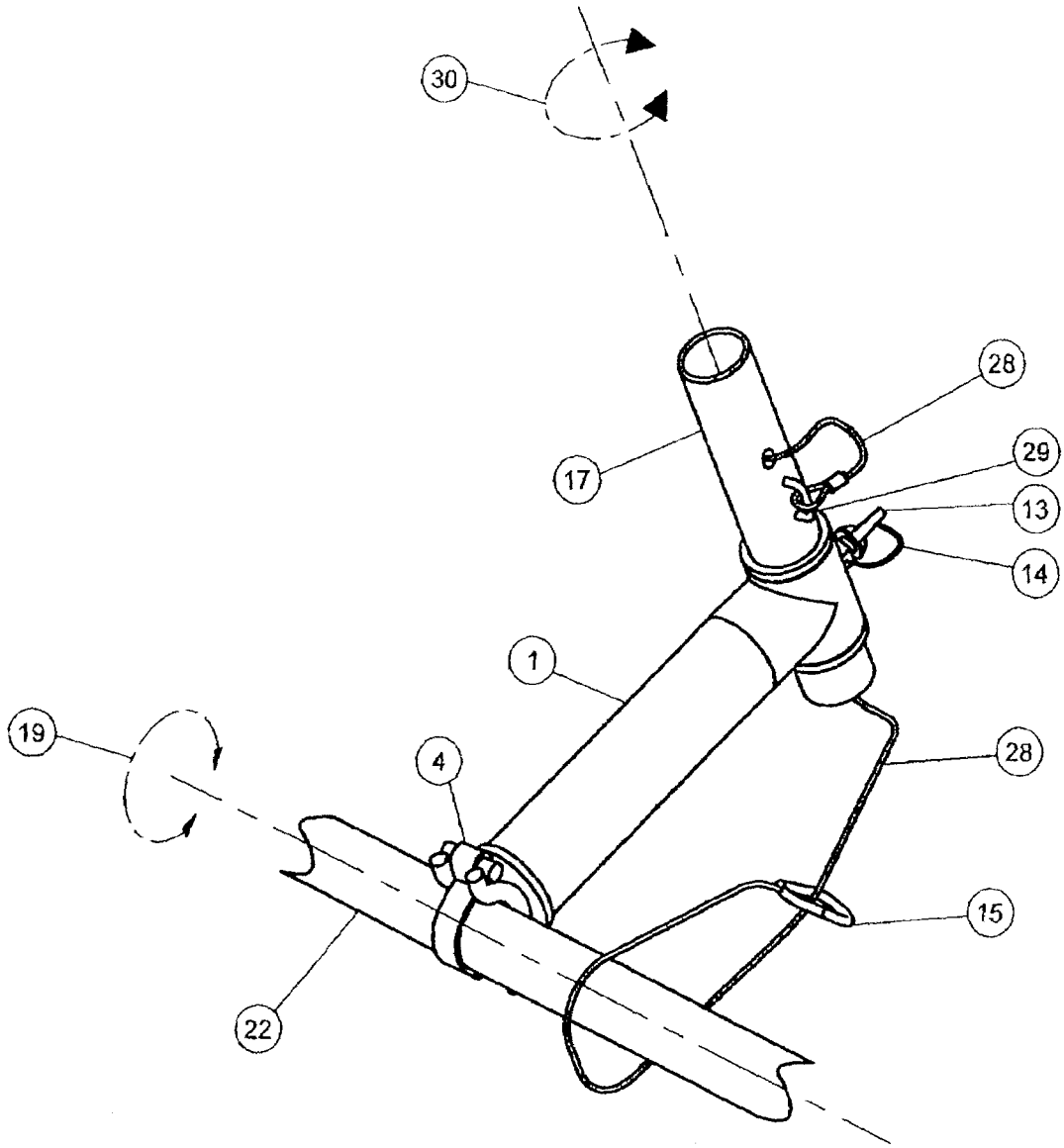
FIG. 2 is an isometric view of a variation of the temporary lighting support assembly in FIG. 1.
Figure 3:
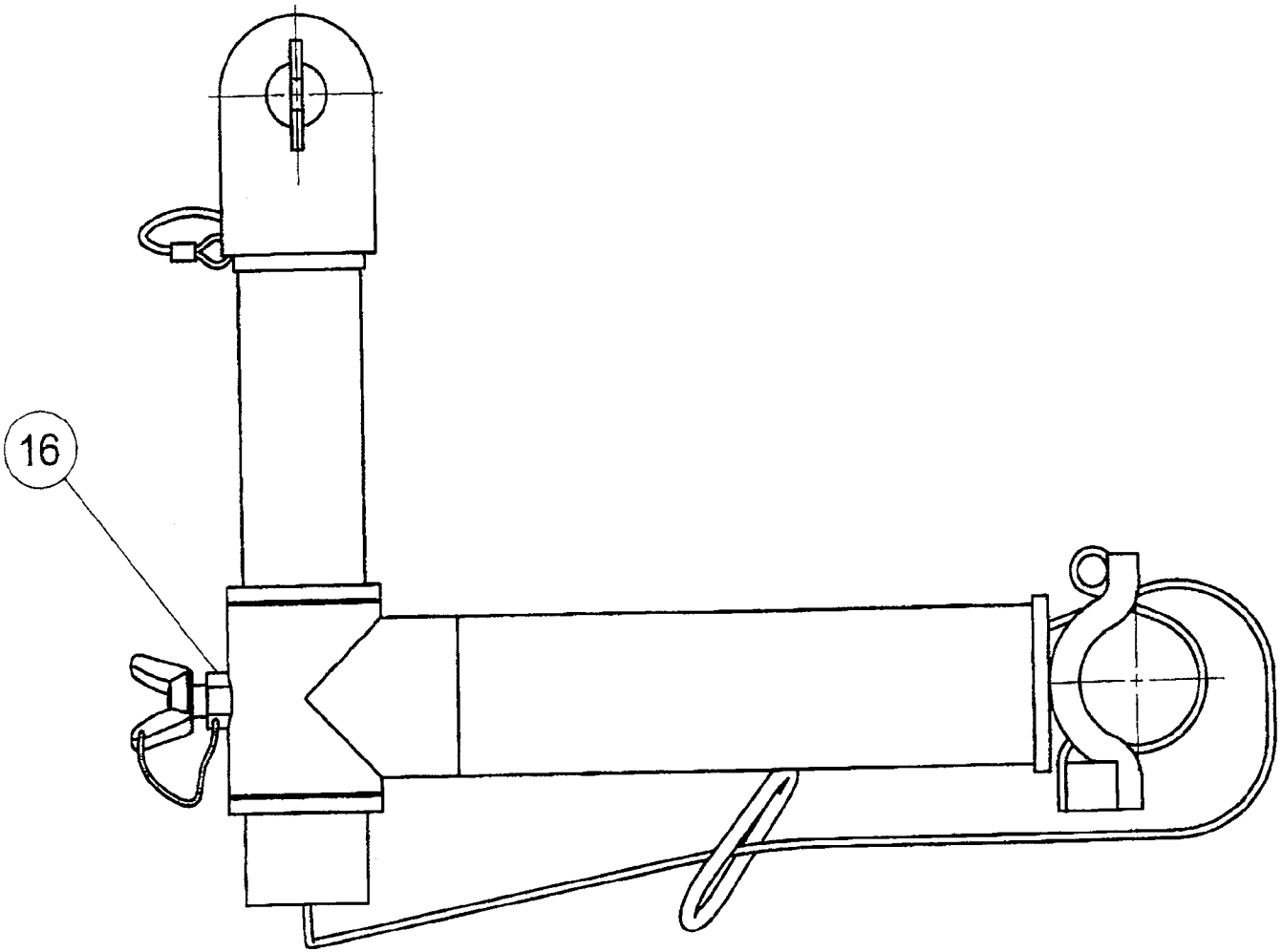
FIG. 3 is an elevation view of the temporary lighting support assembly in FIG. 1.
Figure 4:
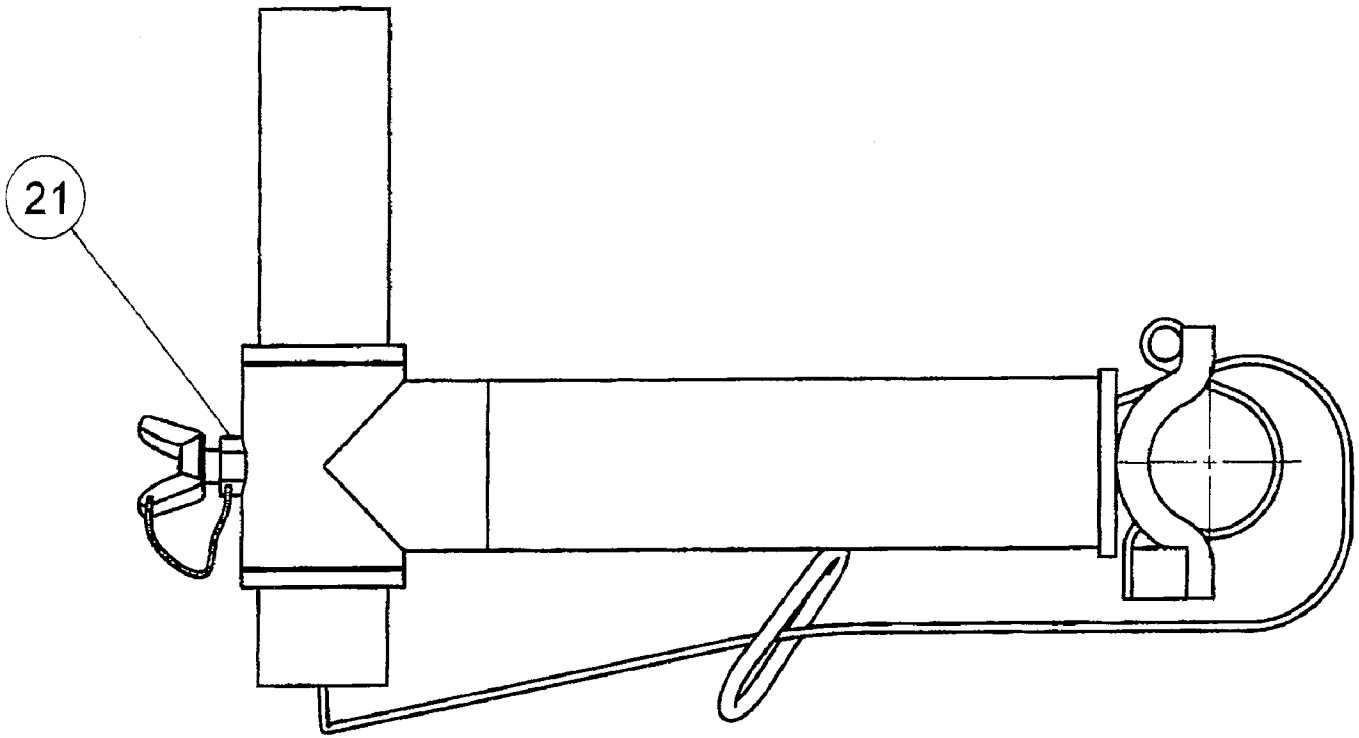
FIG. 4 is an elevation view of the temporary lighting support assembly in FIG. 2.
Figure 5:
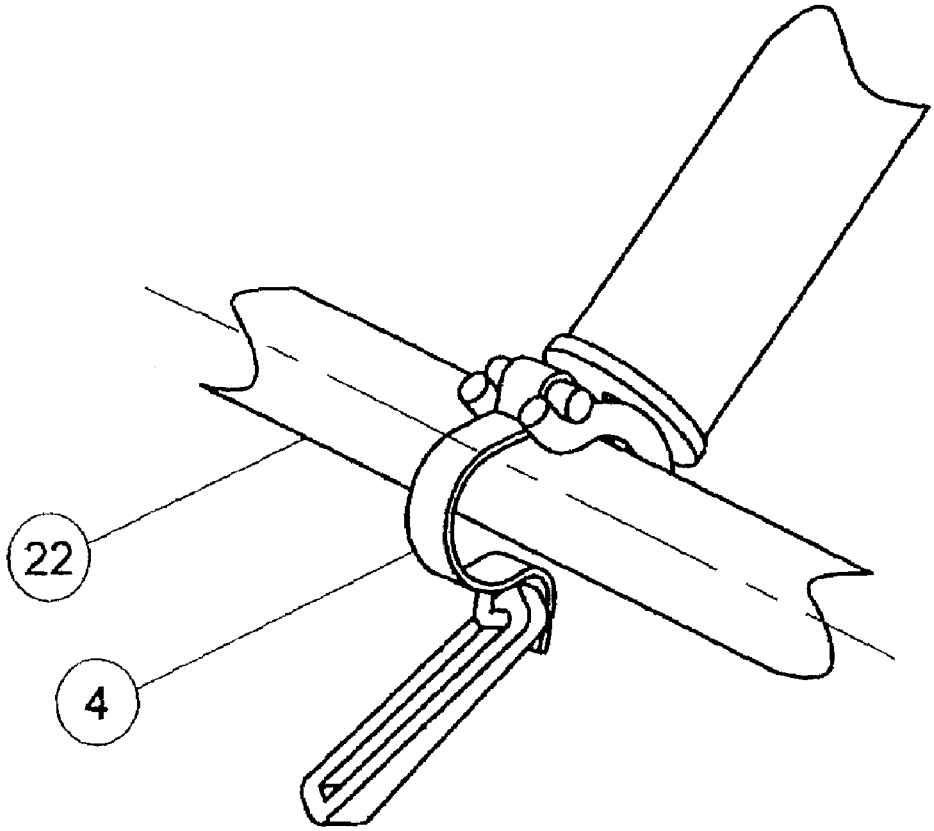
FIG. 5 is an isometric view of the attachment apparatus.

The invention illustrated comprises a support for a temporary lighting fixture that attaches itself to a horizontal scaffold pipe member 22 by means of a scaffold clamp 4. Scaffold clamp 4 is a steel clamp that can be obtained from several manufactures that is welded to pipe 1 in a precise orientation to upright the framework of the support assembly in the direction shown in FIGS. 1 and 2. FIGS. 1 and 2 show the attachment of the support assembly to a horizontal scaffold member 22. Rotation about axis 19 is unlimited until the preferred position is obtained and scaffold clamp 4 is secured. FIG. 5 shows scaffold clamp 4 in the open state during the positioning of the support assembly as mentioned above. Mounting on vertical scaffold members is accomplished in the same manner as horizontal mounting.

Figure 6:
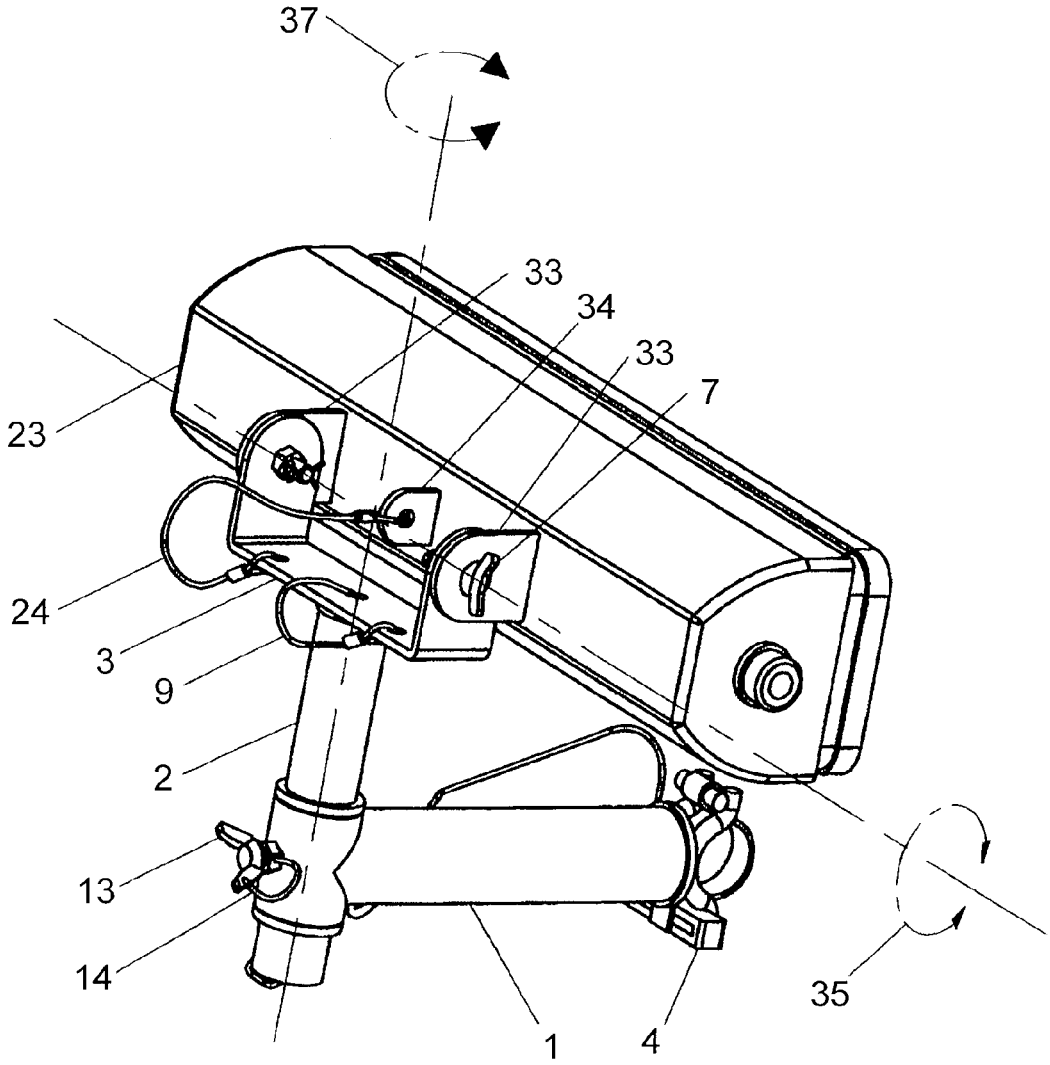
FIG. 6 is a rear isometric view of the temporary lighting support assembly with a light fixture mounted.
Figure 7:
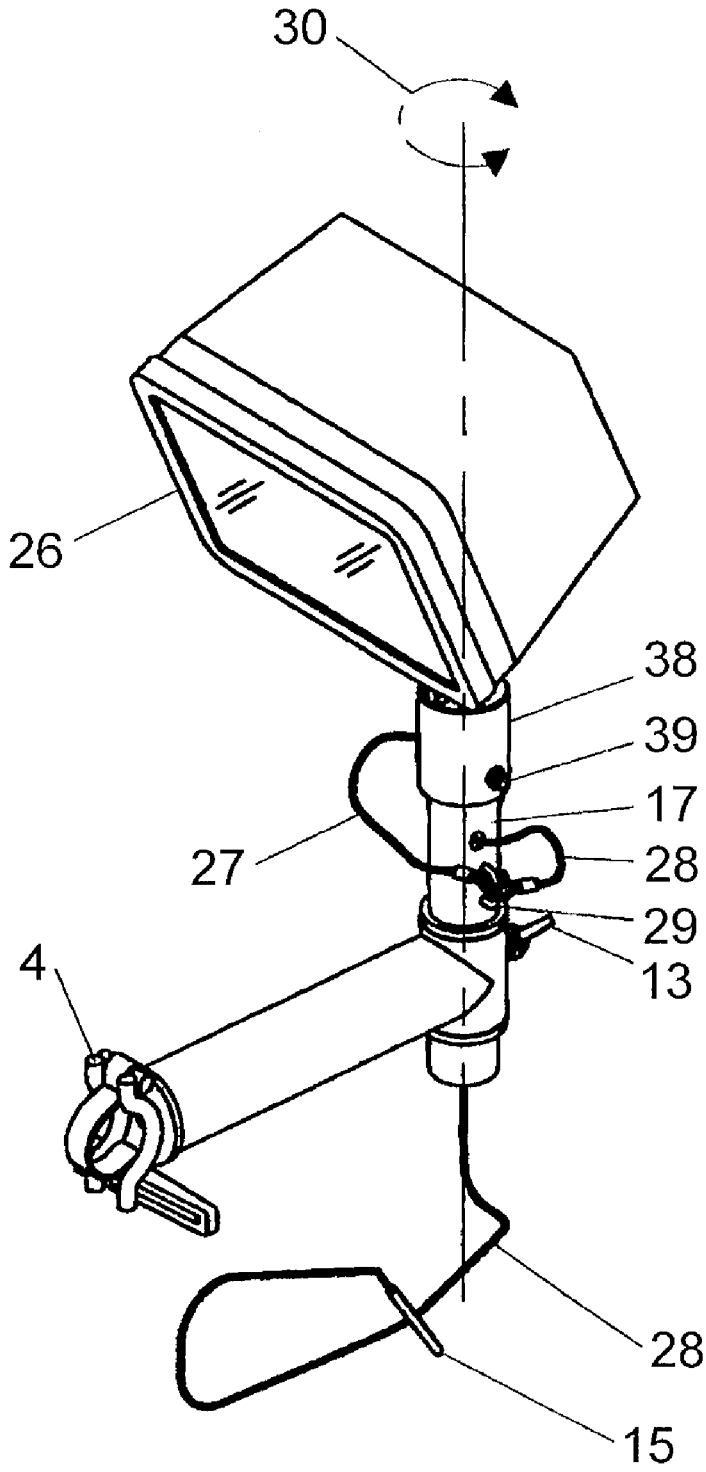
FIG. 7 is a front isometric view of the temporary lighting support assembly with a mast light fixture mounted.
Figure 8:
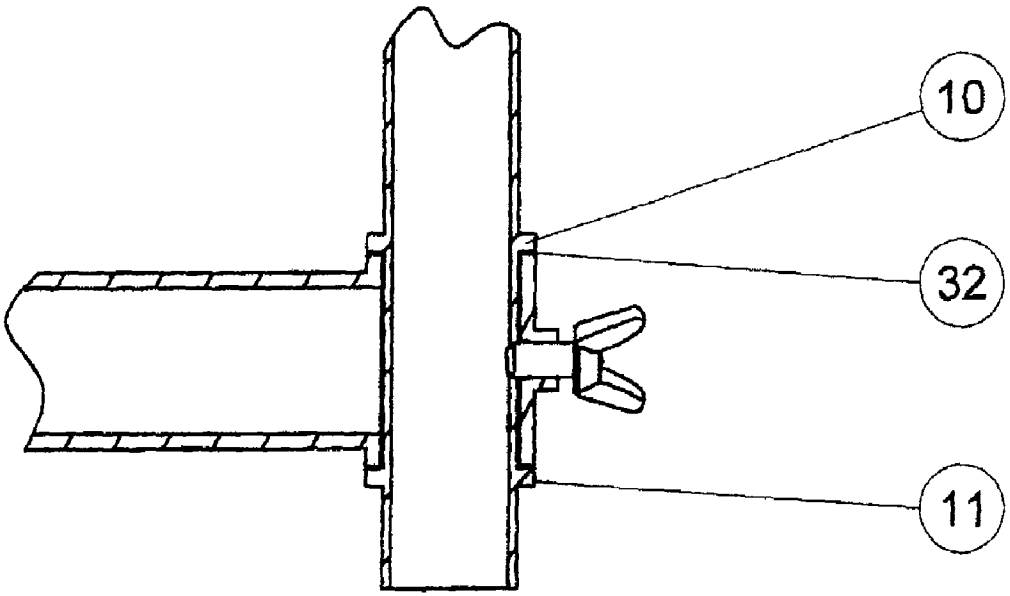
FIG. 8 is a cross-section view of the intersection of pipes at the tee.

FIGS. 6 and 7 show that it is suitable for mounting a linear fixture 23 or mast fixture 26. A steel thin walled tee 12 that is welded to a steel pipe 1 holds steel pipe 2 captive but allows free rotation of pipe 2 on axis 18. Two steel collar washers 10 and 11 are welded to pipe 2. Collar 10 is welded as part of the manufacture of pipe 2 and collar 11 is welded in place as part of the final assembly integration. A small space 32 shown on FIG. 8 is sustained to prevent binding of the collars to the tee. With this configuration full rotation of pipe 2 around axis 18 is obtainable. A steel fixture bracket 3 in the embodiment of FIG. 1 is welded at the top of pipe 2 to receive linear type fixtures. Steel nuts 5 welded to the inside of bracket 3 receive steel wing screws 7. Wing screw 7 is the mechanism used to tighten the linear fixture 23 after the final position is attained. A cotter pin 6 prevents wing screw 7 from backing out during linear fixture 23 fine-tuning or light fixture replacement. Bracket 3 is manufactured to specified dimensions. Linear fixture 23 is modified with the addition of an aluminum or steel ear 33 shown on FIG. 6 where two ears 33 are installed symmetrically at the back of linear fixture 23. Ears 33 fit closely but freely on the outside of bracket 3. Linear fixture 23 can rotate about axis 35 until the desired position is obtained, wing screws 7 are then hand tightened and linear fixture 23 is held in desired position. Modifications to linear fixture 23 are required with the addition of an aluminum or steel ear 34 to connect lanyard line 24 to bracket 3. When the linear fixture 23 is installed and the desired positioned is attained, free rotation about axis 37 of the entire pipe 2 assembly is still possible. When the desired position around axis 37 is achieved, a steel wing screw 13 is hand tightened to hold pipe 2 assembly in place. Lanyard 14 is attached to wing screw 13 to prevent loss of said screw. Lanyard 27 supplied with manufacturer's mast light 26 is tethered to ring 29. FIG. 1 lanyard 36 is tethered at one end of bracket 3 then feed through the inside of pipe 2. When the support is attached to a horizontal or vertical scaffold member lanyard 36 is looped around the scaffold member and a snap hook 15 is attached around the lanyard wire to provide fall arrest of the support assembly.

In the embodiment of FIG. 2, pipe 17 provides a mounting location for a mast light fixture 26 shown in FIG. 7. Mast light 26 is conventionally attached over a pipe by a slip fitting 38. The slip fitting 38 is tightened onto pipe 17 with manufacturer's screws 39. When the mast light is secured to pipe 17 free rotation is still possible around axis 30. Wing screw 13 is tightened when the desired position is obtained. Lanyard 27 supplied with manufacturer's mast light 26 is tethered to ring 29. Likewise to the embodiment of FIG. 1 the embodiment of FIG. 2 shows lanyard 28 tethered at one end to ring 29 then feed through the inside of pipe 17. When the support is attached to a horizontal or vertical scaffold member lanyard 28 is looped around the scaffold member and a snap hook 15 is attached around the lanyard wire to provide fall arrest of the support assembly.

Pipe 1 in both FIGS. 1 and 2 is at a length to have linear fixture 23 and mast fixture 26 set back to a distance suitable to avoid intrusion of the fixture into the platform areas of the scaffolding system. If requirements dictate that intrusion into the platform areas of the scaffolding systems are necessary the support assembly is flexible enough too fully rotate to accommodate full positioning inside the platform area.

It will be noted that, although intended for tube-scaffolding systems, the lighting support assembly can be incorporated into purpose built mast light stands and around industrial and commercial sites where scaffolds tubes can be readily installed.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A support assembly for temporarily attaching lighting fixtures to scaffolding systems, the support assembly comprising:

an elongate support body, the support body comprising a first elongate portion having a first end and a second end, and a second elongate portion, the second elongate portion being rotatably connected to the second end of the first elongate portion at an angle substantially perpendicular to the first elongate portion and rotatable about a first axis that is parallel to the second elongate portion and substantially perpendicular to the first portion;

a releasable clamp attached to the first end of the first elongate portion for attaching the elongate support body to a scaffolding system at an angle substantially perpendicular to the scaffolding system, the releasable clamp being selectively positionable about a second axis parallel to the scaffolding system, and along the scaffolding system in a direction parallel to the second axis; and a lighting fixture attachment connected to the second elongate portion for attaching a lighting fixture, the releasable clamp and the second elongate portion providing the elongate support body with at least three degrees of freedom for positioning the lighting fixture.

2. The support assembly of claim 1, wherein the second end of the first elongate portion comprises a clamp for receiving the second elongate portion, the clamp allowing the second elongate portion to rotate and to move axially along its length.

3. The support assembly of claim 1, wherein a tether is attached to the elongate support body, the tether adapted to be attached to the scaffolding system to provide fall arrest should the release clamp fail.

4. The support assembly of claim 1, wherein the lighting fixture attachment comprises a bracket for adjustably securing a linear fixture.

5. The support assembly of claim 4, wherein the bracket is secured using a fastener that is tightenable by hand.

6. The support assembly of claim 1, wherein the lighting fixture attachment adjustably secures a mast fixture.

7. The support assembly of claim 1, wherein the lighting fixture attachment is adjustable about an axis of rotation offset from and substantially parallel to the scaffolding system to provide a fourth degree of freedom for positioning the lighting fixture.

* * * * *